US012759774B2

(12) United States Patent
Evans et al.

(10) Patent No.: US 12,759,774 B2
(45) Date of Patent: Oct. 13, 2026

(54) DEVICE AND METHOD FOR SECURING FABRIC TO A RIGID MATERIAL

(71) Applicant: Edge-Works Manufacturing Company, Burgaw, NC (US)

(72) Inventors: Scott V. Evans, Jacksonville, NC (US); Nicholas R. Tomczak, Richlands, NC (US)

( * ) Notice: Subject to any disclaimer, the term of this patent is extended or adjusted under 35 U.S.C. 154(b) by 0 days.

(21) Appl. No.: 18/438,267

(22) Filed: Feb. 9, 2024

(65) Prior Publication Data

US 2024/0174417 A1 May 30, 2024

Related U.S. Application Data

(63) Continuation of application No. 17/891,874, filed on Aug. 19, 2022, now Pat. No. 11,897,676, which is a continuation of application No. 16/576,238, filed on Sep. 19, 2019, now Pat. No. 11,453,537.

(60) Provisional application No. 62/733,140, filed on Sep. 19, 2018.

(51) Int. Cl.

| | |
|---|---|
| ***B65D 51/24*** | (2006.01) |
| ***B65D 43/02*** | (2006.01) |
| ***D05B 97/00*** | (2006.01) |

(52) U.S. Cl.

CPC ..... *B65D 51/24* (2013.01); *B65D 43/02* (2013.01); *D05B 97/00* (2013.01); *B65D 2543/00259* (2013.01)

(58) Field of Classification Search

CPC ..... B65D 51/24; B65D 43/02; B65D 2543/00259; B65D 51/02; B65D 51/18; D05B 97/00

USPC ..... 206/3, 372–383; 220/DIG. 9, 11, 212, 220/315, 375, 376, 254.1, 9; 190/902

See application file for complete search history.

(56) References Cited

U.S. PATENT DOCUMENTS

| | | | | |
|---|---|---|---|---|
| 1,894,575 | A * | 1/1933 | Sherman | B65D 43/161 220/254.3 |
| 3,477,553 | A * | 11/1969 | Kish, Jr. | A45C 5/02 190/125 |
| 9,365,332 | B2 * | 6/2016 | Jentis | B65D 51/246 |
| 2008/0210593 | A1 * | 9/2008 | Cornwell | B25H 3/003 206/234 |

(Continued)

FOREIGN PATENT DOCUMENTS

| | | |
|---|---|---|
| JP | 20073301580 | * 12/2007 |

*Primary Examiner* — Chun Hoi Cheung
*Assistant Examiner* — Sanjidul Islam
(74) *Attorney, Agent, or Firm* — Intellectual Property Consulting, LLC; Jared Rovira

(57) ABSTRACT

A portable, resealable storage container and a method for manufacture are provided. The container includes a body having a bottom opposite an opening, and sidewalls attached to the bottom, wherein the body defines a storage cavity. A top having an attachment band and a flap operable to connect to and disconnect from the attachment band covers the opening of the body when connected to the body. A ridge is disposed along an outer surface of the sidewalls and is configured to provide a seat for the attachment band of the top. A mating surface disposed at an upper end of the sidewalls above the ridge and is operable to contact the attachment band of the top. When the top is positioned to sit atop the ridge, the attachment band is in substantially continuous contact with the mating surface. The top is securely fastened to the body.

7 Claims, 7 Drawing Sheets

(56) References Cited

U.S. PATENT DOCUMENTS

| | | | | |
|---|---|---|---|---|
| 2011/0186579 | A1* | 8/2011 | Bailey | B65D 25/54<br>220/795 |
| 2015/0296945 | A1* | 10/2015 | Douglas | A45C 13/08<br>220/592.2 |
| 2018/0215513 | A1* | 8/2018 | Perek | B65D 43/22 |

* cited by examiner

DEVICE AND METHOD FOR SECURING FABRIC TO A RIGID MATERIAL

CROSS REFERENCE TO RELATED APPLICATIONS

This application is a continuation of U.S. patent application Ser. No. 17/891,874, filed Aug. 19, 2022, which was a continuation of U.S. patent application Ser. No. 16/576,238, filed Sep. 19, 2019, now U.S. Pat. No. 11,453,537, issued Sep. 27, 2022, which application claimed priority to U.S. Provisional Patent Application No. 62/733,140, filed Sep. 19, 2018, the entirety each are incorporated by reference as is fully disclosed herein.

INVENTORS: Scott Evans and Nicholas Tomczak

BACKGROUND

The present invention relates in general to a device and method for securing a flexible fabric to a rigid material, such as a plastic or rubber. More specifically, the present invention relates to an improved device and method for securing a flexible fabric cover to a rigid plastic or rubber container used to store ammunition or other tactical gear.

In a tactical environment or situation or training or sporting activity the need of the operator, soldier, law enforcement officer, civilian sportsman or other user to carry various gear on one's person, in support of the mission or activity is always present. As such, users are continually searching for improved items to carry their gear. As a result of this demand, manufacturers of tactical gear especially are always looking for new and improved methods to more efficiently manufacture such gear.

A common item is a gear box that is comprised of a container composed of a hard, rigid material (e.g. a plastic or rubber) with a flexible fabric cover sewn into the container, wherein the fabric cover includes a zipper closure that allows the user access to the contents of the box.

Current methods for sewing a flexible fabric cover to a rigid container require the manufacturer to manually sew the fabric cover into the rigid container so that it is in parallel alignment along the perimeter of the container with the bottom and top portions of the container. This process can be tedious—generally requiring the manufacturer to use chalk, or some other marking device, to outline the sewing seam. Special care must be given at this stage because the seam attaching the fabric cover to the container runs along the perimeter at the very top of container portion. Often, during the sewing process, the fabric becomes misaligned causing the seam to no longer be parallel with the top or bottom end of the container. Such an error not only affects the aesthetic appeal of the box, but can also lead to a bad connection between the cover and the container if a portion of the seam fails to make contact with the container.

Furthermore, when the fabric cover is sewed directly onto the container, the bottom portion of the cover is inevitably offset from the walls of the container. Since this is not a flush connection, the bottom portion of the fabric cover is more susceptible to being caught on external objects, which will cause tearing and may potentially rupture the seam keeping the fabric cover attached to the rigid container.

As such, there is a need for a new sewing method to ensure that the seam attaching a fabric cover to a rigid container remains in proper alignment and sits flush along the perimeter of a container during the sewing process.

BRIEF SUMMARY OF THE INVENTION

The present invention describes a method for sewing a predominately fabric cover onto a predominately rigid container, wherein the method ensures that the fabric seam is in proper alignment and sits flush along the perimeter of the container.

In accordance with embodiments of the invention, a portable, resealable storage container is provided. The container has a body having a bottom opposite an opening and sidewalls attached to the bottom. The body defines a storage cavity. The container has a top having an attachment band and a flap. The flap is operable to connect to and disconnect from the attachment band. The top covers the opening of the body when connected to the body. A ridge is disposed along an outer surface of the sidewalls and ridge configured to provide a seat for the attachment band of the top. A mating surface is disposed at an upper end of the sidewalls and operable to contact the attachment band of the top. When the top is positioned to sit atop the ridge, the attachment band is in substantially continuous contact with the mating surface. The top is securely fastened to the body.

In one embodiment, the body is formed of a molded material.

In another embodiment, the top is manufactured from cloth.

In a further embodiment, the ridge is formed as part of the molding process for the body.

In one embodiment, the ridge is formed as a portion of the sidewalls.

In another embodiment, the ridge is formed around the entire periphery of the sidewalls.

In one embodiment, one or more ridges are formed within one or more sidewalls.

In another embodiment, two ridges are formed within opposing sidewalls.

In a further embodiment, the flap connects to the attachment band with a zipper, buttons, or magnets.

In another embodiment, the top is secured to the mating surface by sewing.

In accordance with embodiments of the invention, a method of securing a fabric to a rigid material portable, resealable storage container is provided. The method includes a first step of fabricating a top, the top having an attachment band and a flap, the flap operable to connect to and disconnect from the attachment band. The top is operable to cover an opening of a body. The method includes a second step of forming a body having a bottom opposite an opening, sidewalls attached to the bottom, and a ridge disposed along an outer surface of the sidewalls. The ridge is operable to provide a seat for the attachment band of the top. The body further includes a mating surface at an upper end of the sidewalls above the ridge and is operable to contact the attachment band of the top. The method includes a third step of positioning the top onto the body such that the attachment band sits upon the ridge to provide alignment and to prevent misalignment during a fastening process. The method includes a fourth step of fastening the top to the body by using a fastening process such that the top is securely fastened to the body and substantially parallel to the ridge.

In one embodiment, the body is formed of a molded material.

In another embodiment, the ridge is formed as part of the molding process for the body.

In a further embodiment, the ridge is formed as a portion of the sidewalls.

In one embodiment, the top is made from cloth.

In another embodiment, the flap connects to the attachment band with a zipper.

In a further embodiment, the fastening process is sewing.

In accordance with embodiments of the invention, a method for attaching a fabric to a rigid component to prevent misalignment during the attachment process is provided. The method includes a first step of fabricating a rigid component, the rigid component having a wall, a ridge, and a mating surface. The method includes a second step of aligning a piece of fabric with the ridge, such that an edge of the fabric is in substantial and continuous contact with the ridge, and at least a portion the fabric is in substantial and continuous contact with the mating surface. The method includes a third step of fastening the fabric to the rigid component by using a fastening process, such that the fabric is securely fastened to the rigid component and substantially parallel to the ridge.

In one embodiment, the fastening process is sewing.

DETAILED DESCRIPTION

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

As used herein, "axis" means a real or imaginary straight line about which a three-dimensional body is symmetrical. A "vertical axis" means an axis perpendicular to the ground (or put another way, an axis extending upwardly and downwardly). A "horizontal axis" means an axis parallel to the ground.

As used herein, homogeneous is defined as the same in all locations, and a homogeneous material is a material of uniform composition throughout that cannot be mechanically separated into different materials. Examples of "homogeneous materials" are certain types of plastics, ceramics, glass, metals, alloys, paper, board, resins, high-density polyethylene and rubber.

Figure 1:
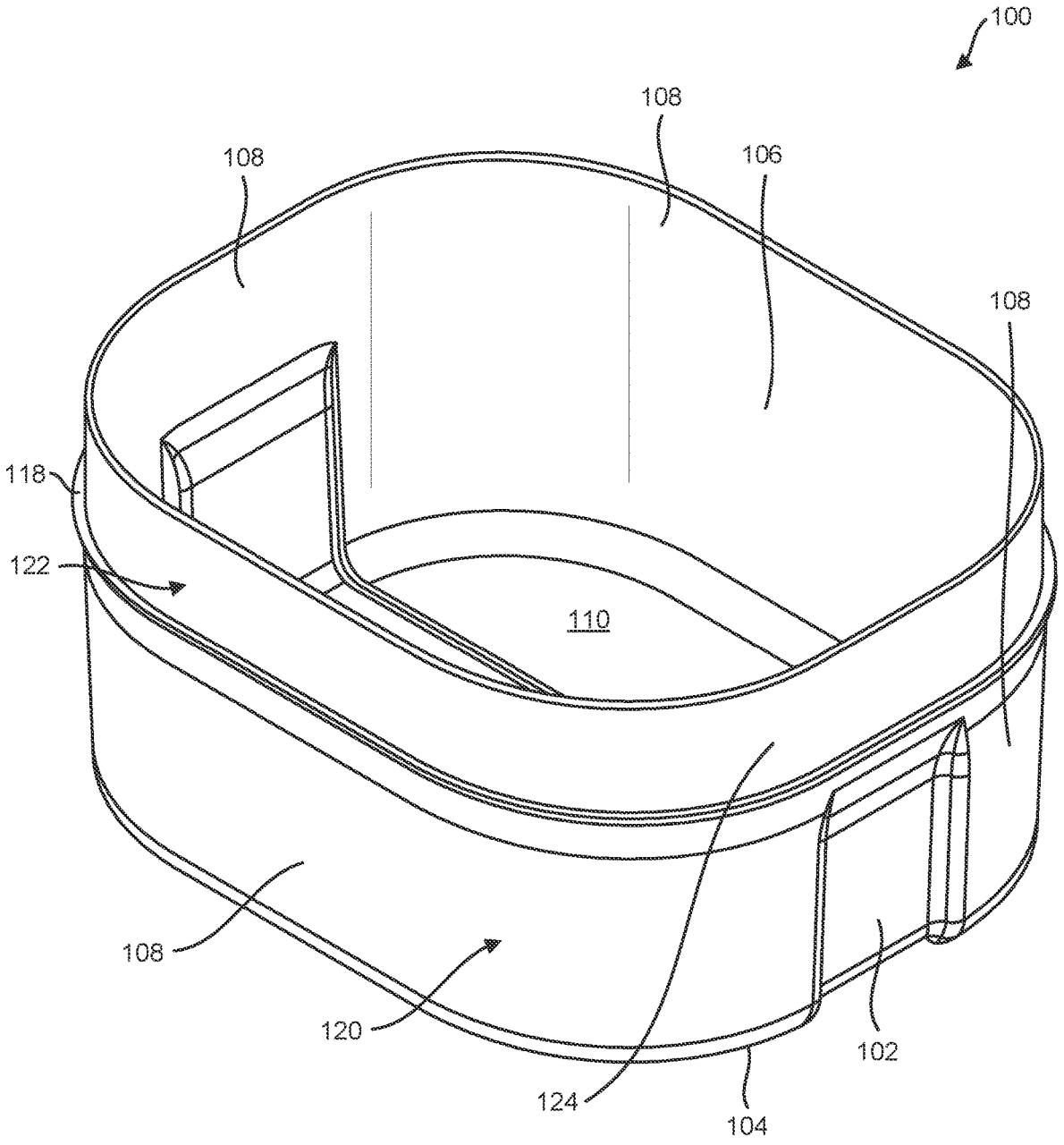
FIG. 1 is a right front perspective view of a container in accordance with embodiments of the invention.
Figure 2:
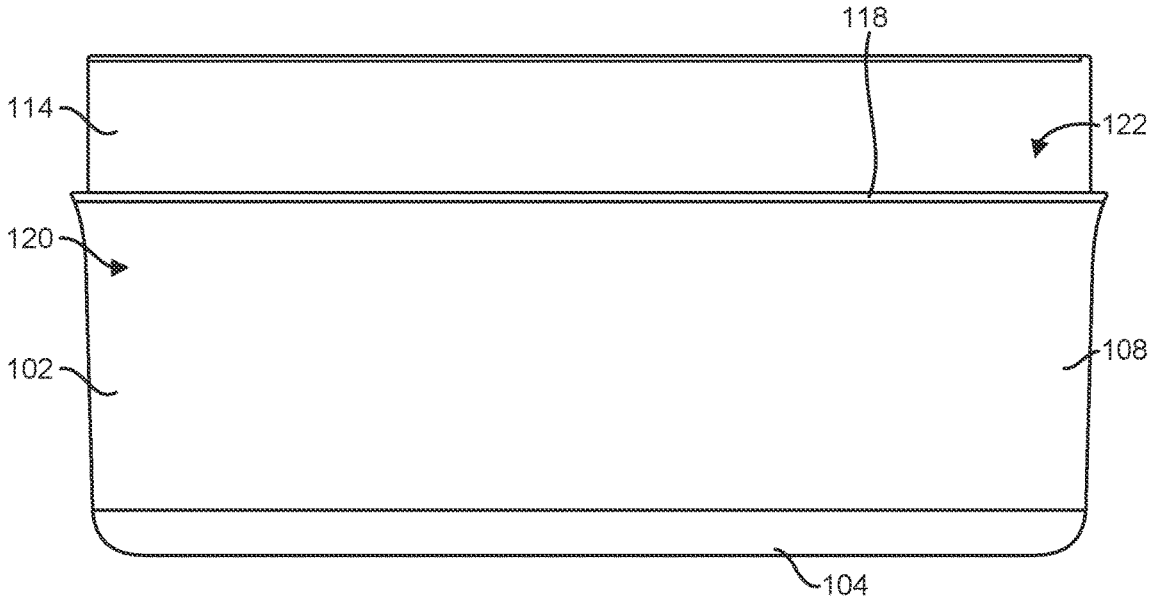
FIG. 2 is a front view of a container in accordance with embodiments of the invention.
Figure 3:
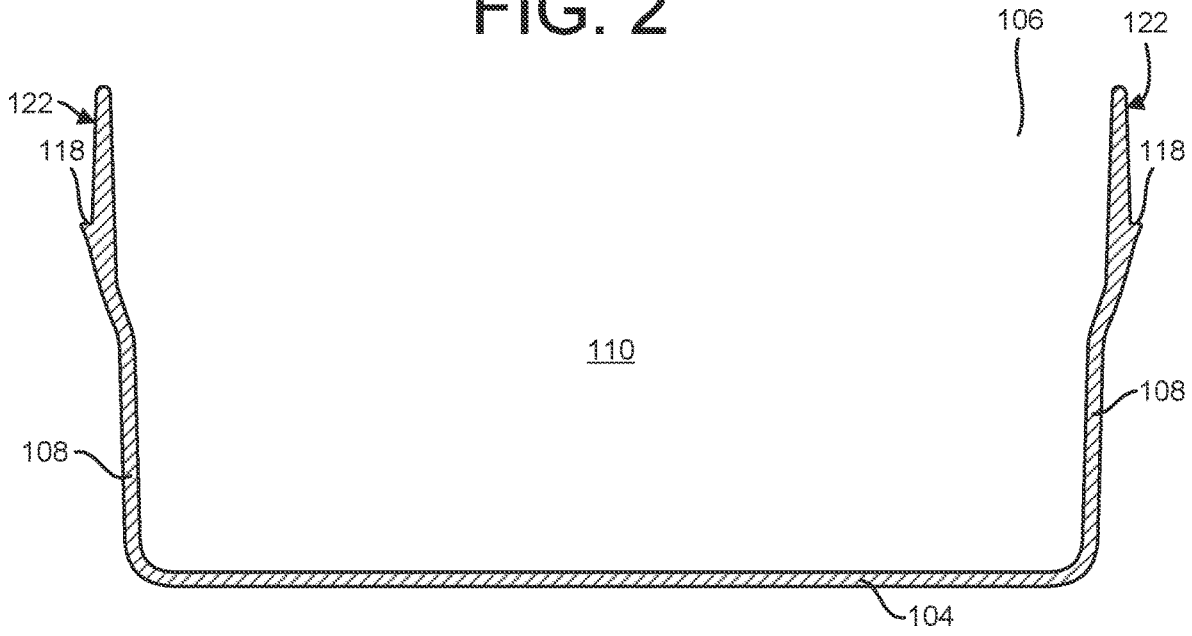
FIG. 3 is a cross sectional view of a container in accordance with embodiments of the invention.
Figure 4:
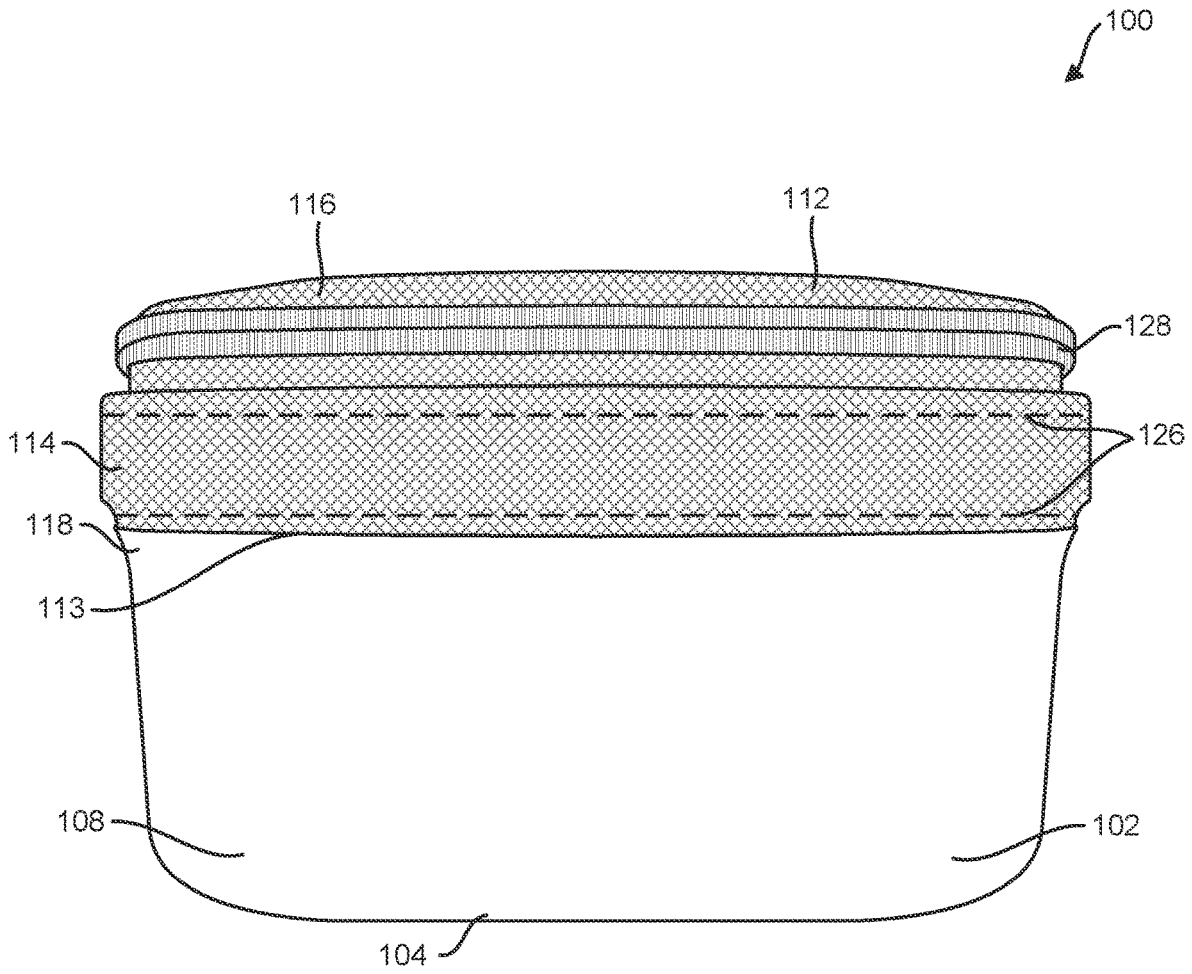
FIG. 4 is a is a front view of a container with a fabric top in accordance with embodiments of the invention.
Figure 5:
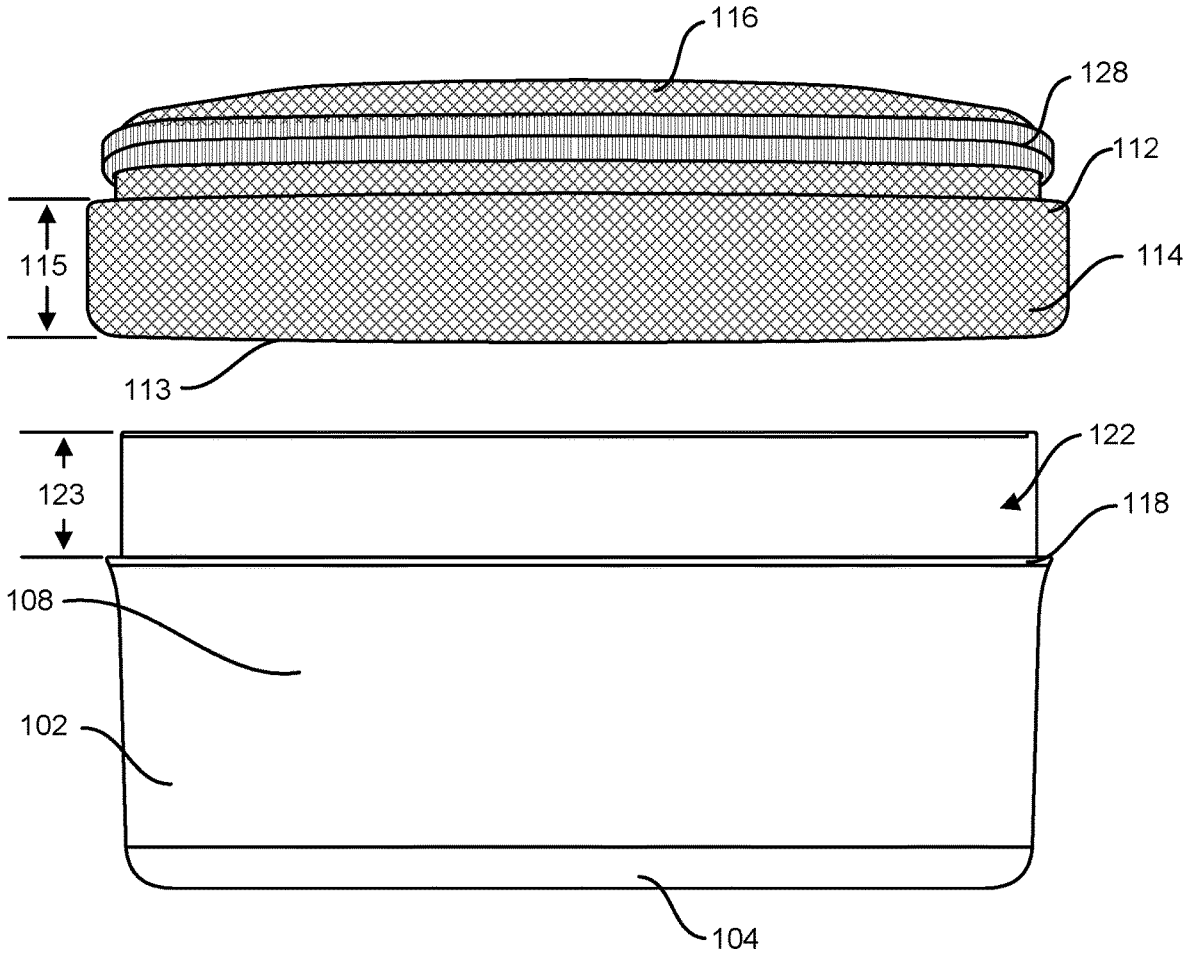
FIG. 5 is an exploded view of a container with a fabric top in accordance with embodiments of the invention.

The present invention includes a device and improved method for sewing a predominately flexible fabric cover onto a predominately rigid container. In accordance with embodiments of the invention, a portable, resealable storage container 100 is provided, the container 100 having a body 102 and a top 112. Referring to the embodiments illustrated in FIGS. 1-6, the body 102 has a bottom 104 opposite an opening 106 and sidewalls 108 attached to the bottom 104. In one embodiment, the body 102 is formed of a rigid or molded material, such as a plastic or a rubber, for example. The body defines a storage cavity 110. The container has a top 112 having an attachment band 114 and a flap 116, as illustrated in FIG. 4. The top 112 may be made of cloth, for example. The flap 116 is operable to connect to and disconnect from the attachment band 114. The flap 116 connects to the attachment band 114 via a selectively sealable mechanism such as by a zipper 128, buttons (not shown), or magnets (not shown). The top 112 covers the opening 106 of the body 102 when connected to the body 102. The attachment band 114 has a width 115.

In the embodiments illustrated in FIGS. 1-6, a ridge 118 is disposed along an outer surface 120 of the sidewalls 108 and ridge 118 configured to provide a seat for the attachment band 114 of the top 112. The ridge 118 may be formed as part of the molding process for the body 112, formed as a portion of the sidewalls 108, or formed around the entire periphery of the sidewalls 108, for example. In one embodiment, one or more ridges are formed within one or more sidewalls. In another embodiment, two ridges are formed within opposing sidewalls. In one embodiment, the distance that the ridge 118 extends from the outer surface 120 of the wall 108 is to be substantially equal to the thickness of the fabric material used for the top 112.

Figure 6:
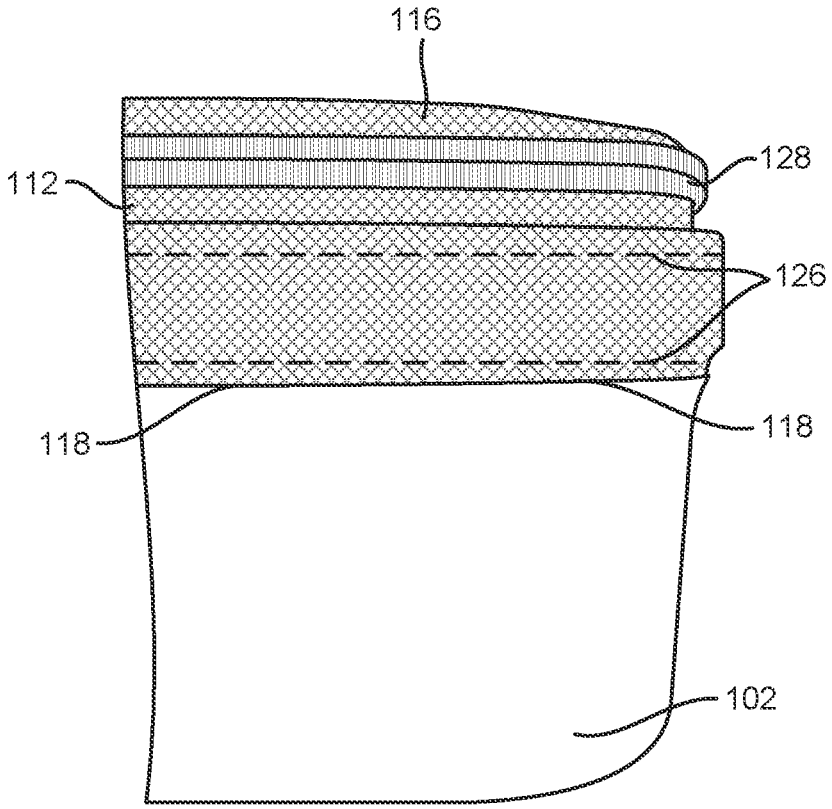
FIG. 6 is a cutaway view of a container with a fabric top in accordance with embodiments of the invention.

A mating surface 122 is disposed at an upper end 124 of the sidewalls 108 and operable to contact the attachment band 114 of the top 112. The mating surface 122 has a width 123. When the top 112 is positioned to sit atop the ridge 118, the attachment band 114 is in substantially continuous contact with the mating surface 122. The top 112 is securely fastened to the body 102. As illustrated in FIGS. 4 and 6, the top is secured to the mating surface by sewing, as can be seen with seams 126. In one embodiment, the top 112 is secured to the mating surface 122 by an adhesive. As seen illustrated in FIGS. 4 and 6, when the thickness of the attachment band 114 of the top 112 is substantially the same width of the ridge 118, the attachment band 114 sits flush with the sidewalls 108 of the body 102. In the embodiment illustrated in the Figures, the width 123 of the mating surface 122 is roughly equal to the width 115 of the attachment band 114.

Figure 7:
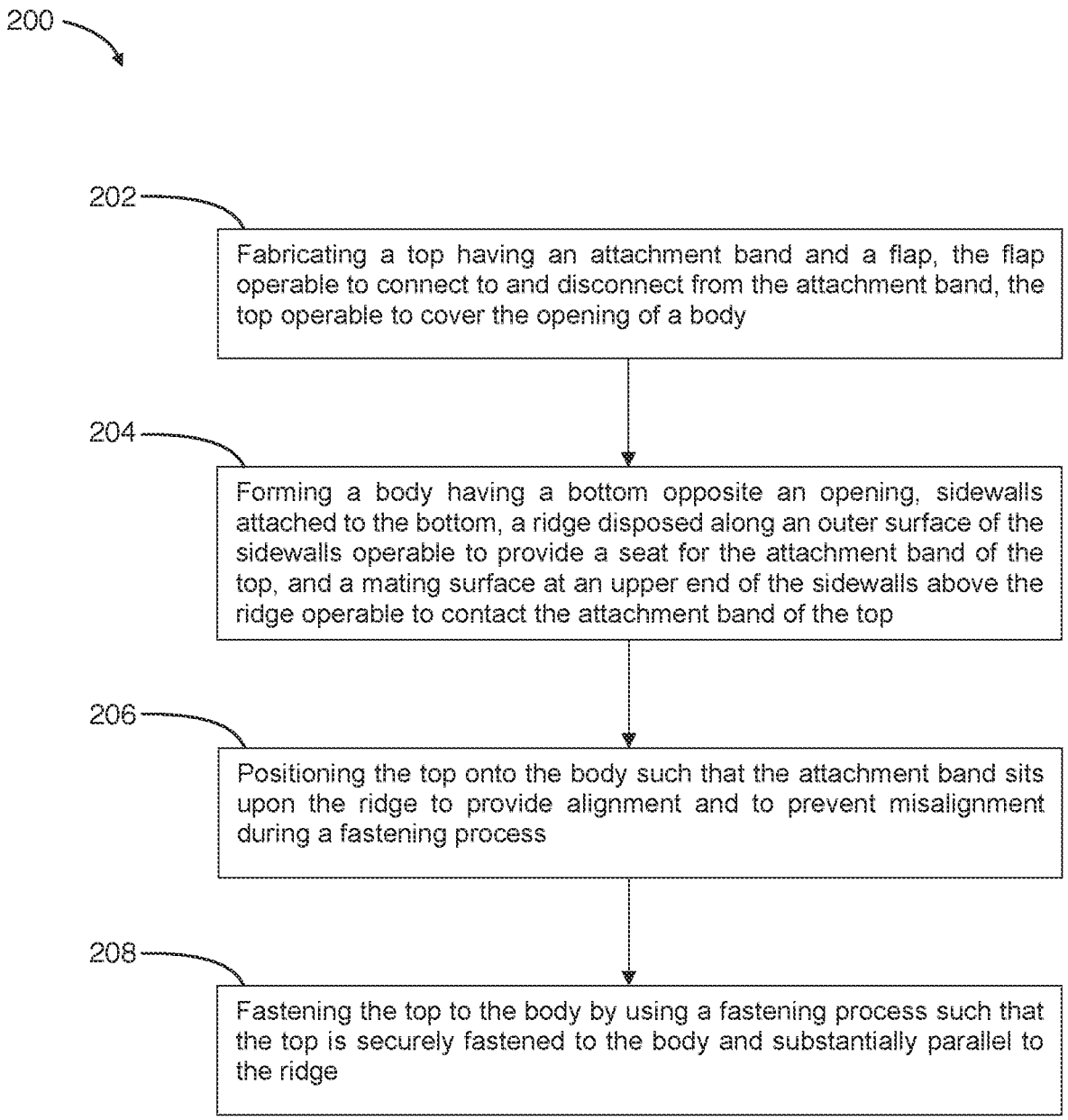
FIG. 7 is a flow chart illustrating a method of manufacturing in accordance with embodiments of the invention.

In accordance with embodiments of the invention, a method 200 of securing a fabric to a rigid material portable, resealable storage container is provided, as illustrated by the flow chart in FIG. 7. The method includes 200 a first step 202 of fabricating a top 112, the top 112 having an attachment band 114 and a flap 116. The flap 116 is operable to connect to and disconnect from the attachment band 114 by zipper, buttons, or magnets, for example. The top 112 is operable to cover an opening of a body 102. The top may be made from cloth, for example. The method 200 includes a second step 204 of forming a body 102 having a bottom 104 opposite an opening 106, sidewalls 108 attached to the bottom 104, and a ridge 118 disposed along an outer surface 120 of the sidewalls 108. The body 102 may be formed of a molded material, such as plastic, for example. The ridge 118 is operable to provide a seat for the attachment band 114 of the top 112. The ridge 118 may be formed as part of the molding process for the body 102 or the side walls 108, for example. The body 102 further includes a mating surface 122 at an upper end 124 of the sidewalls 108 and is operable to contact the attachment band 114 of the top 112. The method 200 includes a third step 206 of positioning the top 112 onto the body 102 such that the attachment band 114 sits upon the ridge 118 to provide alignment and to prevent misalignment during a fastening process. The method 200 includes a fourth step 208 of fastening the top 112 to the body 102 by using a fastening process 130 such that the top 112 is securely fastened to the body 102 and positioned substantially parallel to the ridge 118. Exemplary forms of fastening the top 112 to the body 102 are sewing or the use of adhesive.

Figure 8:
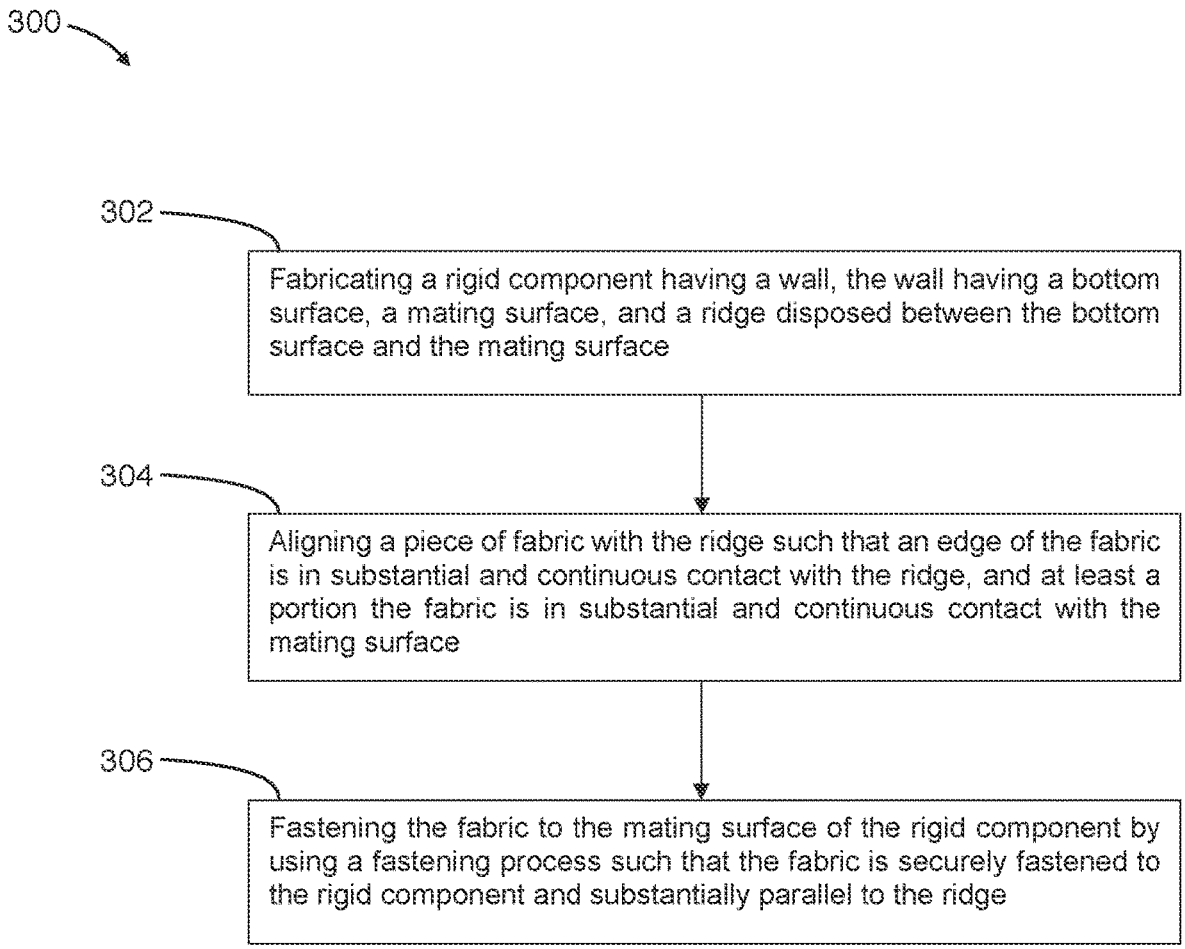
FIG. 8 is a flow chart illustrating a method of manufacturing in accordance with embodiments of the invention.

In accordance with embodiments of the invention, a method 300 for attaching a fabric to a rigid component to prevent misalignment during the attachment process is provided, as illustrated by the flow chart in FIG. 8. The method includes a first step 302 of fabricating a rigid component 102, the rigid component having a wall 108, a ridge 118, and a mating surface 122. The method includes a second step 304 of aligning a piece of fabric 112 with the ridge 118, such that an edge 113 of the fabric 112 is in substantial and continuous contact with the ridge 118, and at least a portion the fabric 112 is in substantial and continuous contact with the mating surface 122. The method includes a third step 306 of fastening the fabric 112 to the rigid component 102 by using a fastening process, such that the fabric 112 is securely fastened to the rigid 102 component and substantially parallel to the ridge 118. The fastening process may be sewing or adhesive, for example.

The method described above is scalable and can be applied towards any device where a flexible fabric is being sewn into a ridged material; the method provides an easy guide for the sewing seam to be positionally aligned along the indented lip and allow the fabric's surface to be flush with the rigid material's surface.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

The invention claimed is:

1. A portable container, comprising:

a body, the body having a bottom opposite an opening, the body having sidewalls attached to the bottom;

a top;

a ridge disposed around a perimeter of an outer surface of the sidewalls, the ridge configured to provide a seat for the top;

a mating surface defined by a portion of the outer surface of the sidewalls between the ridge and the opening;

wherein a portion of the top is positioned to sit atop the seat of the ridge and against the mating surface, and wherein the top is permanently fastened to the body along the entire perimeter of the mating surface;

wherein the body is manufactured from a rigid or molded material; and wherein the top is manufactured from fabric, cloth, or a woven material.

2. The container of claim 1 comprising an attachment band, wherein the attachment band is positioned to sit atop the ridge and against the mating surface, and wherein the attachment band is permanently fastened to the entire perimeter of the mating surface.

3. The container of claim 1, wherein the top is secured to the mating surface by sewing or adhesive.

4. The container of claim 1, wherein the ridge is formed as part of a molding process for the body.

5. The container of claim 1, wherein the ridge is formed as a portion of the sidewalls.

6. The container of claim 1, wherein the ridge is formed around the entire periphery of the sidewalls.

7. A portable container, comprising:

a body, the body having a bottom opposite an opening, the body having sidewalls attached to the bottom;

a top;

a ridge disposed around a perimeter of an outer surface of the sidewalls, the ridge configured to provide a seat for the top;

a mating surface defined by a portion of the outer surface of the sidewalls between the ridge and the opening; and wherein a portion of the top is positioned to sit atop the seat of the ridge and against the mating surface, and wherein the top is permanently fastened to the body along the entire perimeter of the mating surface wherein the top further comprises a flap, the flap being configured to cover the opening, and wherein the top further comprises a zipper closure operable to open and close the flap.

* * * * *